US005932525A

United States Patent [19]

Ney et al.

[11] Patent Number: 5,932,525

[45] Date of Patent: Aug. 3, 1999

[54] LUBRICATING OILS COMPRISING LOW SATURATE BASESTOCK

[75] Inventors: Johan Ney, Cologne, Germany; Robert Robson; Trevor Russell, both of Oxfordshire, United Kingdom

[73] Assignee: Exxon Chemical Patents, Inc., Linden, N.J.

[21] Appl. No.: 08/817,676

[22] PCT Filed: May 22, 1996

[86] PCT No.: PCT/EP96/02268

§ 371 Date: Apr. 3, 1997

§ 102(e) Date: Apr. 3, 1997

[87] PCT Pub. No.: WO96/39477

PCT Pub. Date: Dec. 12, 1996

[30] Foreign Application Priority Data

Jun. 5, 1995 [GB] United Kingdom ..... 9511267

[51] Int. Cl.[6] ..... C10M 149/00

[52] U.S. Cl. ..... 508/287; 508/293; 508/551; 508/554

[58] Field of Search ..... 508/287, 551

[56] References Cited

U.S. PATENT DOCUMENTS 4,234,435 11/1980 Meinhardt et al. ..... 252/51.5 A 5,427,702 6/1995 Chung et al. ..... 252/51.5 A

FOREIGN PATENT DOCUMENTS 0 400 866 12/1990 European Pat. Off. .

WO 94/13763 6/1994 WIPO .

WO 96/39477 12/1996 WIPO .

*Primary Examiner*—Ellen M. McAvoy

*Attorney, Agent, or Firm*—Ohlandt, Greeley, Ruuggiero & Perle

[57] ABSTRACT

Multigrade lubricating oils for use in lubricating internal combustion engines, using basestocks with low levels (<75 mass %) of saturated hydrocarbons, comprise less than 3 mass % of ashless dispersant derived from a polymer of number average molecular weight ($\bar{M}n$) of not greater than 5000, and a viscosity modifier package to give the desired viscometrics comprising at least one multifunctional viscosity modifier. These oils meet stringent engine performance requirements and specifically give adequate varnish inhibition without very high treat levels of dispersants and/or use of specific detergent systems so avoiding problems of oxidation stability, compatibility and engine performance debits.

14 Claims, No Drawings

LUBRICATING OILS COMPRISING LOW SATURATE BASESTOCK

This invention relates to multigrade lubricating oils for use in lubricating internal combustion engines, that contain basestocks with low levels of saturated hydrocarbons, and specifically to such oils which also comprise a multifunctional viscosity modifier.

Multigrade lubricating oils typically are identified by designations such as SAE 10W-30, 5W-30 etc. The first number in the multigrade designation is associated with a maximum low temperature (e.g.,–20° C.) viscosity requirement for that multigrade oil as measured typically by a cold cranking simulator (CCS) under high shear rates (ASTM D5293, which is a revision of ASTM D2602), while the second number in the multigrade designation is associated with a high temperature viscosity requirement usually measured in terms of the kinematic viscosity (kV) at 100° C. (ASTM D445). Thus, each particular multigrade oil must simultaneously meet both strict low and high temperature viscosity requirements, set e.g. by SAE specifications such as SAE J300, in order to qualify for a given multigrade oil designation.

The high temperature viscosity requirement is intended to prevent the oil from thinning out too much during engine operation which can lead to excessive wear and oil consumption. The maximum low temperature viscosity requirement is intended to facilitate engine starting in cold weather and to ensure pumpability, i.e., the cold oil should readily flow to the oil pump, otherwise the engine can be damaged due to insufficient lubrication.

The viscosity characteristic of a basestock on which a lubricating oil is based is typically expressed by the neutral number of the oil (e.g., S150N) with a higher neutral number being associated with a higher viscosity at a given temperature. Blending basestocks is one way of modifying the viscosity properties of the resulting lubricating oil. Unfortunately, merely blending basestocks of different viscosity characteristics may not enable the formulator to meet the low and high temperature viscosity requirements of some multigrade oils. The formulator's primary tool for achieving this goal is an additive conventionally referred to as a viscosity modifier (VM) or viscosity index improver (V.I. improver).

A monofunctional VM is conventionally an oil-soluble long chain polymer. A multifunctional VM (or alternately MFVM) is an oil soluble polymer which has been chemically modified e.g., functionalized and derivatized, to impart dispersancy as well as viscosity modification.

The basestocks which are typically used in lubricating oils may be synthetic or natural oils. Mineral oils contain various amounts of saturated hydrocarbons, such as straight or branched chain paraffins and naphthenes, and unsaturated hydrocarbons particularly aromatic hydrocarbons. Lubricating oils have traditionally used basestocks containing high levels of saturated hydrocarbon—also referred to as high saturate basestocks—since aromatic hydrocarbons give rise to difficulties in formulating for adequate performance in internal combustion engines. This has been known for some time, being discussed, for example, in "Lubricants for Fluid Film and Hertzian Contact Conditions", T. I. Fowle, Proc. Instn. Mech. Engrs. 1967–8, Vol 182, Pt 3A, pages 568–576, especially pages 568/9 and 571/2. More recently, "Chemistry and Technology of Lubricants", edited by R. M. Mortier and S. T. Orszulik, Blackie Academic and Professional, 1992, in chapter 1, "Base oils from Petroleum" R. J. Prince, pages 1–31, discusses the instability of aromatic components to oxidation which is still perceived as a problem. "Compositional Analysis of Re-refined and Non-Conventional Lubricant Base Oils: Correlations to Sequence VE and IIIE Gasoline Engine Tests", Stipanovic et aL, SAE Technical Paper Series, 941978, Oct. 17–20 1994 provides a statistical analysis in those engine tests which indicates a strong negative impact of various aromatic hydrocarbon types. Among other consequences it is generally accepted that there is a tendency for unsaturated components and particularly aromatic components of basestocks to contribute to the formation of baked-on deposits in engines, generally referred to as "varnish".

As discussed in the literature identified above, special and expensive finishing treatments are required to remove aromatics from basestocks and so increase the level of saturates. Increasingly there is a need for lubricating oils for internal combustion engines which are capable of utilising basestocks with low levels of saturates. In order to meet stringent engine performance requirements and specifically to give adequate varnish inhibition to those oils with conventional types of additive formulations it has proved necessary to use very high treat levels of dispersants and/or to use specific detergent systems. This is economically undesirable and also give rise to further problem within the oil formulation, as those high levels of additives can bring their own problems of oxidation stability, compatibility and engine performance debits.

This invention relates to multigrade lubricating oils which utilise low saturate basestocks and provide adequate varnish performance without requiring high levels of dispersant and/or detergent additives.

Thus, in one aspect the invention provides a multigrade lubricating oil for an internal combustion engine which comprises:

a. a basestock of lubricating oil viscosity having less than 75 mass % of saturated hydrocarbons;

b. less than 3 mass % of ashless dispersant derived from a polymer of number average molecular weight ($\overline{M}n$) of not greater than 5000; and c. viscosity modifier to give the desired viscometrics, which comprises at least one multifunctional viscosity modifier.

DETAILED DESCRIPTION

A. Basestock

As indicated above conventional lubricating oils are prepared using basestocks which have relatively high levels of saturates and thus low levels of unsaturated and specifically aromatic hydrocarbons. Mineral basestocks are typically subjected to hydrogen treatments such as hydrocracking or hydroisomerisation in order to give greater paraffinic content and lower aromatic content. The basestock used in the lubricating oil of the invention does not require such treatments and may use lower grade basestocks previously regarded as unsuitable for such applications. Such basestocks for use in the invention are typically mineral oils which have not been subjected to severe treatments to raise the saturates level, but the invention may employ any of the available synthetic or natural oils, re-refined oils and mixtures of such oils, provided the overall saturates level of the basestock or basestock mixture is less than 75 mass %, preferably less than 70 mass %, and may even use basestocks of less than 65 mass % saturates. Such basestocks may contain at least 20%, preferably at least 30 mass % of aromatic compounds and may even contain in excess of 35 mass % of aromatic compounds.

Additives used in formulating lubricating oils often contain diluent oil; this diluent oil introduced with additives is not included within the term "basestock" as that term is used herein, which is confined to the oil used to dilute the additives to form the finished oil.

The lubricating oil basestock conveniently has a viscosity of from 2.5 to 12 $mm^2/s$, and preferably from 2.5 to 9 $mm^2/s$, at 100° C. Examples of commercially available basestocks of low saturates content which may be employed in the invention are ESN 600 (typically 69.9 mass % saturates; 30.1 mass % aromatics) available from Esso Petroleum Co. Ltd., Agip 450 (typically 64.7 mass % saturates; 35.3 mass % aromatics) available from Agip Petroli and BP 500ME (typically 61.9 mass % saturates; 38.1 mass % aromatics) available from B.P. pic. Such low saturate basestocks may be used alone or in combination with other basestocks, which may also have low saturates content or have relatively higher saturate content, provided that the saturate content of the combined basestock as that term is used herein is less than 75 mass % of the total basestock.

B. Ashless Dispersant

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides- thiocarboxylate derivatives of long chain hydrocarbons; long chain aliphatic hydrocarbons having a polyamine attached directly thereto, and Mannich condensation products formed by condensing a long chain substituted phenol with formaldehyde and polyalkylene polyamine.

The oil soluble polymeric hydrocarbon backbone is typically an olefin polymer, especially polymers comprising a major molar amount (i.e. greater .ia 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble pentene, octene-1, styrene), and typically a $C_2$ to $C_5$ olefin. The oil soluble polymeric hydrocarbon backbone may be a homopolymer (e.g. polypropylene or polyisobutylene) or a copolymer of two or more of such olefins (e.g. copolymers of ethylene and an alphaolefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene).

One preferred class of olefin polymers is polybutenes and specifically polyisobutenes (PIB) or poly-n-butenes, such as may be prepared by polymerization of a $C_4$ refinery stream.

Another preferred class of olefin polymers is ethylene alpha-olefin (EAO) copolymers or alpha-olefin homo- and copolymers having in each case a high degree (e.g.>30%) of terminal vinylidene unsaturation. That is, the polymer has the structure: P-HCR=$CH_2$ wherein P is the polymer chain and R is a $C_1$–$C_{18}$ alkyl group, typically methyl or ethyl. Preferably the polymers have at least 50% of the polymer chains with terminal vinylidene unsaturation. EAO copolymers of this type preferably contain 1 to 50 mass % ethylene, and more preferably 5 to 45 mass % ethylene. Such polymers may contain more than one alpha-olefin and may contain one or more $C_3$ to $C_{22}$ diolefins. Also usable are mixtures of EAO's of low ethylene content with EAO's of high ethylene content. The EAO's may also be mixed or blended with PIB's of various $\overline{M}n$'s or components derived from these may be mixed or blended. Atactic propylene oligomer typically having $\overline{M}n$ of from 700 to 500 may also be used, as described in EP-A490454.

Suitable olefin polymers and copolymers, such as polyisobutenes, may be prepared by cationic polymerization of hydrocarbon feedstreams, usually $C_3$–$C_5$, in the presence of a strong Lewis acid catalyst and a reaction promoter, usually an organoaluminum such as HCI or ethylaluminum dichloride. Tubular or stirred reactors may be used. Such polymerizations and catalysts are described, e.g., in U.S. Pat. Nos. 4,935,576 and 4,952,739. Fixed bed catalyst systems may also be used as in U.S. Pat. No. 4,982,045 and UK-A 2,001,662. Most commonly, polyisobutylene polymers are derived from Raffinate I refinery feedstreams. Conventional Ziegier-Natta polymerization may also be employed to provide olefin polymers suitable for use to prepare dispersants and other additives.

The preferred EAO polymers may be prepared by polymerizing the appropriate monomers in the presence of a catalyst system comprising at least one metallocene (e.g. a cyclopentadienyl-transition metal compound) and preferably an activator, e.g. an alumoxane compound. The metallocenes may be formed with one, two, or more cyclopentadienyl groups, which are substituted or unsubstituted. The metallocene may also contain a further displaceable ligand, preferably displaced by a cocatalyst—a leaving group—that is usually selected from a wide variety of hydrocarbyl groups and halogens. Optionally there is a bridge between the cyclopentadienyl groups and/or leaving group and/or transition metal, which may comprise one or more of a carbon, germanium, silicon, phosphorus or nitrogen atom-containing radical. The transition metal may be a Group IV, V or VI transition metal. Such polymerizations and catalysts are described, for example, in U.S. Pat, Nos. 4,871,705, 4,937,299, 5,017,714, 5,120,867, 4,665,208, 5,153,157, 5,198,401, 5,241,025, 5,057,475, 5,096,867, 5,055,438, 5,227,440, 5,064,802; EP-A-129368, 520732, 277003, 277004, 420436; WO91/04257, 93/08221, 93/08199 and 94/13715.

The oil soluble polymeric hydrocarbon backbone of the ashless dispersant, as that term is used herein, has a number average molecular weight ($\overline{M}n$) of not greater than 5,000. The $\overline{M}n$ of the backbone is preferably within the range of 500 to 5,000, more preferably 700 to 5,000 where the use of the backbone is to prepare a component having the primary function of dispersancy. Hetero polymers such as polyepoxides are also usable to prepare components. Both relatively low molecular weight ($\overline{M}n$ 500 to 1500) and relatively high molecular weight ($\overline{M}n$ 1500 to 5,000) polymers are useful to make dispersants. Particularly useful olefin polymers for use in dispersants have $\overline{M}n$ within the range of from 1500 to 3000.

The $\overline{M}n$ for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The oil soluble polymeric hydrocarbon backbone may be functionalized to incorporate a functional group into the backbone of the polymer, or as pendant groups from the polymer backbone. The functional group typically will be polar and contain one or more hetero atoms such as P, 0, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer by oxidation or cleavage of a small portion of the end of the polymer (e.g., as in ozonolysis).

Useful functionalization reactions include. halogenation of the polymer at an olefinic bond and subsequent reaction of the halogenated polymer with an ethylenically unsaturated functional compound. reaction of the polymer with an unsaturated functional compound by the "ene" reaction absent halogenation (an example of the former functionalization is maleation where the polymer is reacted with maleic acid or anhydride); reaction of the polymer with at least one phenol group (this permits derivatization in a Mannich Base-type condensation), reaction of the polymer at a point of unsaturation with carbon monoxide using a Koch-type reaction to introduce a carbonyl group in an iso or neo position, reaction of the polymer with the functionalizing compound by free radical addition using a free radical catalyst, reaction with a thiocarboxylic acid derivative; and reaction of the polymer by air oxidation methods, epoxidation, chioroamination, or ozonolysis.

The functionalized oil soluble polymeric hydrocarbon backbone is then further derivatized with a nucleophilic amine, amino-alcohol, or mixture thereof to form oil soluble salts, amides, imides, amino-esters, and oxazolines. Useful amine compounds include those described herein after in more detail in relation to the MFVM. Preferred amines are aliphatic saturated amines. Non-limiting examples of suitable amine compounds include. 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene) triamine.

Useful amines also include polyoxyalkylene polyamines and the polyamido and related amido-amines as disclosed in U.S. Pat, Nos. 4,857,217, 4,956,107, 4,963,275 and 5229022. Also usable is tris(hydroxymethyl)amino methane (THAM) as described in U.S. Pat. Nos. 4,102,798, 4,113,639 and 4,116,876; and GB-A-989409. Dendrimers, star-like amines, and comb-structure amines may also be used. Similarly, one may use the condensed amines of U.S. Pat. No. 5,053,152. The functionalized polymer of this invention is reacted with the amine compound according to conventional techniques as in EP-A-208560 and U.S. Pat. No. 5,229,022 using any of a broad range of reaction ratios as described therein.

A preferred group of nitrogen containing ashless dispersants includes those derived from polyisobutylene substituted with succinic anhydride groups and reacted with polyethylene amines (e.g. tetraethylene pentamine, pentaethylene, polyoxypropylene diamine) aminoalcohols such as trismethylolaminomethane and optionally additional reactants such as alcohols and reactive metals e.g. pentaerythritol, and combinations thereof).

Also useful as nitrogen containing ashless dispersants are dispersants wherein a polyamine is attached directly to the long chain aliphatic hydrocarbon as shown in U.S. Pat, Nos. 3,275,554 and 3,565,804 where a halogen group on a halogenated hydrocarbon is displaced with various alkylene polyamines. Another class of nitrogen-containing ashless dispersants comprises Mannich base condensation products. Such Mannich condensation products may include a long chain, high molecular weight hydrocarbon (e.g., $\overline{M}n$ of 1,500 or greater) on the benzene group or may be reacted with a compound containing such a hydrocarbon, for example, polyalkenyl succinic anhydride as shown in U.S. Pat. No. 3,442,808.

Examples of dispersants prepared from polymers prepared from metallocene catalysts and then functionalized, derivatized, or functionalized and derivatized are described in U.S. Pat. Nos. 5,266,223, 5,128,056, 5,200,103, 5,225,092, 5,151,204 and 5,334,775; WO-A-94/13709 and 94/19436; and EP-A440506, 513211 and 513157.

The functionalizations, derivatizations, and post-treatments described in the following patents may also be adapted to functionalize and/or derivative the preferred polymers described above: U.S. Pat. Nos. 3,275,554, 3,565,804, 3,442,808, 3,442,808, 3,087,936 and 3254025.

C. Viscosity Modifiers

The multifunctional viscosity modifier may be one or more of: polymethacrylates derivatised with nitrogen containing monomers such as vinylpyridine, N-vinylpyrrolidinone, or N,N'-dimethylaminoethyl methacrylate; ethylene-propylene copolymers directly amine derivatised, hydrogenated star polymers reacted with a carboxylic acid derivative and then reacted with an amine; hydrogenated styrenebutadiene-ethylene oxide block copolymers; and ethylene alphaolefin copolymers solution or melt grafted with ethylenically unsaturated a dicarboxylic acid derivative and then reacted with an amine. Typically multifunctional viscosity modifiers are derived from a polymer having a number average molecular weight ($\overline{M}n$) of greater than 7000, as distinct from ashless dispersants, as defined above.

In a preferred aspect the multifunctional viscosity modifier comprises a derivatized ethylene-alpha olefin copolymer comprising an adduct of (i) a copolymer having a number average molecular weight of from 20,000 to 100,000, functionalized with mono- or dicarboxylic acid material; and (ii) at least one amine, and in a particularly preferred aspect the ethylene-alpha olefin copolymer comprises either a) from 30 to 60 weight percent monomer units derived from ethylene and from 70 to 40 weight percent monomer units derived from alpha-olefin, or b) from 60 to 80 weight percent monomer units derived from ethylene and from 40 to 20 weight percent monomer units derived from alpha olefin.

A highly preferred class of multifunctional viscosity modifiers which may be used in the invention comprise a mixture of derivatised ethylene-alpha olefin copolymers A and B, both comprising an adduct of (i) a copolymer having a number average molecular weight of from 20,000 to 100,000, functionalized with mono- or dicarboxylic acid material; and (ii) at least one amine, and wherein:

the ethylene-alpha olefin copolymer of derivatized copolymer A comprises from 30 to 60 weight percent monomer units derived from ethylene and from 70 to 40 weight percent monomer units derived from alpha-olefin; and the ethylene-alpha olefin copolymer of derivatized copolymer B comprises from 60 to 80 weight percent monomer units derived from ethylene and from 40 to 20 weight percent monomer units derived from alpha olefin, with the proviso that the respective weight percents of ethylene derived monomer units present in said derivatized copolymers A and B differ by at least 5 weight percent.

The multifunctional viscosity modifiers used in the present invention may be prepared by known techniques. The preferred mixture of derivatized ethylene-alpha-olefin copolymers may be prepared by functionalising and derivatising ethylene alphaolefin copolymers such as described in EP-A-616616 and WO-A-94/1 3763.

Ethylene Alpha-olefin Copolymers

The ethylene-alpha olefin copolymers comprise monomer units derived from ethylene and alpha-olefins which are typically $C_3$ to $C_{28}$, preferably $C_3$ to $C_{18}$, most preferably $C_3$ to $C_8$ alpha olefins. While not essential, such polymers preferably have a degree of crystallinity of less than 25 wt. percent as determined by x-ray and differential scanning calorimetry. Copolymers of ethylene and propylene are most preferred.

Representative examples of other suitable alpha-olefins include 1-butene, 1-pentene, 1-hexene, 1-heptene, 1-octene, 1-nonene, 1-decene, etc; also branched chain alpha-olefins, such as 4 methyl-1-pentene, 4-methyl-1-hexene, 5 methyl pentene-1, 4.4 dimethyl-1-pentene, and 6 methylheptene-1 and mixtures thereof. Ter- and tetra- copolymers are included within the scope of "copolymers".

Ethylene alpha-olefin copolymers used in the invention preferably have a number average molecular weight ($\overline{M}n$) of from 25,000 to 80,000 and most preferably from 25,000 to about 50,000. Suitable polymers will typically have a narrow molecular weight distribution (MWD), as determined by the ratio of weight average molecular weight ($\overline{M}w$) to number average molecular weight ($\overline{M}n$). Polymers having a $\overline{M}w/\overline{M}n$ of less than 10, preferably less than 7, and more preferably 4 or less are most desirable. As used herein ($\overline{M}n$) and ($\overline{M}w$) may be measured by well known techniques such as vapor phase osmometry (VPO), membrane osmometry and gel permeation chromatography (GPC). The synthesis of polymers having a suitable molecular weight and narrow MWD may be obtained by techniques known in the art including choice of synthesis conditions and post synthesis treatment such as extrusion at elevated temperature, high shear mastication under elevated temperatures in the presence of peroxides or air. thermal degradation, and fractional precipitation from solution.

The copolymers employed to make the component blends of the present invention are differentiated primarily by their ethylene content. Derivatised copolymer A is derived from a low ethylene monomer unit content copolymer and derivatised copolymer B is derived from a high ethylene monomer unit content copolymer. More specifically, the low ethylene content copolymer will comprise preferably from 40 to 50 and most preferably from 42 to 46 (e.g., 44) weight percent monomer units derived from ethylene; and preferably from 60 to 50, and most preferably from 58 to 54 (e.g., 56) weight percent monomer units derived from alpha-olefin. The high ethylene content copolymer will comprise preferably from 65 to 75, and most preferably from 68 to 73 (e.g., 70) weight percent monomer units derived from ethylene; and preferably from 35 to 25, and most preferably from 32 to 27 (e.g., 30) weight percent monomer units derived from alpha-olefin.

The above ethylene contents are subject to the proviso that the ethylene content of the high and low ethylene copolymers must differ by at least 5, preferably at least and most preferably at least 15 weight percent.

For ease of discussion, derivatised copolymers derived from the low ethylene content copolymer, as described above, are referred to herein as Component A, and derivatised copolymers derived from the high ethylene content copolymer, as described above, are referred to herein as Component B.

Many such ethylene alpha olefin copolymers are available as items of commerce and their composition and methods for producing them are well known in the art. Representative examples include: MDV-90-9 manufactured by Exxon Chemical Company, an ethylene-propylene copolymer containing 70 weight percent ethylene, which is further characterized by a Mooney viscosity, ML, 1+4 @ 125° C. of 18; and VISTALON 457 manufactured by. Exxon Chemical Company, a 44 weight percent ethylene, ethylene-propylene copolymer which is further characterized by a Mooney viscosity, ML 1+4 @ 125° C. of 28.

As indicated above, the MFVM used in present invention comprises a blend of Components A and B. Such blends will comprise typically weight ratios (referred to herein as "blend ratios") of A: B of from 2.3:1 to 0.18: 1, preferably from 1.2:1 to 0.25: 1, and most preferably from 0.8:1 to 0.33:1. Such blend ratios are also applicable to unfunctionalized high and low ethylene content polymer blends in preparation for functionalization. To prepare the MFVM used in the present invention, the high and low ethylene alpha-olefin copolymers are first functionalized and then derivatized.

Functionalized Polymers

By functionalized, it is meant that the polymer is chemically modified to have at least one functional group present within its structure, which functional group is capable of undergoing further chemical reaction (e.g., derivatization) with other materials. The preferred functionalization reaction is accomplished by reaction of the polymer with a compound containing the desired functional group by free radical addition using a free radical catalyst. More specifically, polymer functionalized with mono- or dicarboxylic acid material, i.e., acid, anhydride, salt or acid ester suitable for use in this invention, typically includes the reaction product of the polymer with a monounsaturated carboxylic reactant comprising at least one of (i) monounsaturated $C_4$ to $C_{10}$ dicarboxylic acids (preferably wherein (a) the carboxyl groups are vicinyl, i.e., located on adjacent carbon atoms and (b) at least one, more preferably both, of said adjacent carbon atoms are part of said monounsaturation). (ii) derivatives of (i) such as anhydrides or $C_1$ to $C_5$ alcohol derived mono- or diesters of (i); (iii) monounsaturated $C_3$ to $C_{10}$ monocarboxylic acids wherein the carbon-carbon double bond is conjugated allylic to the carboxyl group, i.e., of the structure —C═C—CO—; and (iv) derivatives of (iii) such as $C_1$ to $C_5$ alcohol derived monoesters of (iii).

Suitable unsaturated acid materials thereof which are useful functional compounds, include acrylic acid, crotonic acid, methacrylic acid, maleic acid, maleic anhydride, fumaric acid, itaconic acid, itaconic anhydride, citraconic acid, citraconic anhydride, mesaconic acid, glutaconic acid, choromaleic acid, aconitic acid, crotonic acid, methylcrotonic acid, sorbic acid, 3-hexenoic acid, 10-decenoic acid, 2-pentenel,3,5-tricarboxylic acid, cinnamic acid, and lower alkyl (e.g., $C_1$ to $C_4$ alkyl) acid esters of the foregoing, e.g., methyl maleate, ethyl fumarate, methyl fumarate, etc. Particularly preferred are the unsaturated dicarboxylic acids and their derivatives, especially maleic acid, fumaric acid and maleic anhydride.

The two functionalised copolymers described above can be prepared in several ways. The functional groups can be grafted onto each of the copolymers separately and then the functionalized copolymers can then be mechanically blended at the above described blend ratios. In the preferred method for practicing the invention, the two copolymers are simultaneously functionalized and blended at the same time by feeding into an extruder, masticator or reactor.

The extrusion process is continuous, while the masticator process is a batch process. Both take place in a polymer melt, i.e., the polymer is melted in the high temperature, high shear conditions of this equipment. The functionalization takes place substantially in absence of a solvent. The reactor process is a process similar to the masticator batch process but the polymer is functionalized once it is dissolved in a solvent such as mineral oil. The extruder and masticator processes can provide efficient peroxide and or thermo oxidative induced molecular weight reduction of the copolymers, should a lower molecular weight be desired than that of the copolymer that is available.

It will be understood that blends of the high and low ethylene content polymers will create a bimodal distribution of ethylene content not achievable by making a single polymer having a single average ethylene content.

Free-radical induced grafting can take place in a polymer melt in a extruder or masticator, or when using a conventional batch reactor with the polymer dissolved in a solvent, preferably in a mineral lubricating oil. The free-radical grafting is preferably carried out using free radical initiators such as peroxides, hydroperoxides, and azo compounds and preferably those which have a boiling point greater than about 100° C. and which decompose thermally within the grafting temperature range to provide said free radicals. The initiator is generally used at a level of between about 0.005 percent and about 1 percent, based on the total weight of the polymer.

The ethylenically unsaturated carboxylic acid material, preferably maleic anhydride, will be generally used in an amount ranging from 0.01 percent to 10 percent, preferably 0.1 to 2.0 percent, based on weight of copolymer. The aforesaid carboxylic acid material and free radical initiator are generally used in a weight percent ratio range of 1.0:1 to 30:1, preferably 3.0:1 to 6:1.

When the copolymer grafting takes place in a solvent in a reactor, the initiator grafting is preferably carried out in an inert atmosphere, such as that obtained by nitrogen blanketing. While the grafting can be carried out in the presence of air, the yield of the desired graft polymer is generally thereby decreased as compared to grafting under an inert atmosphere substantially free of oxygen. The grafting time will usually range from 0.1 to 12 hours, preferably from 0.5 to 6 hours, more preferably 0.5 to 3 hours. In the grafting process, usually the copolymer solution is first heated to grafting temperature and thereafter said unsaturated carboxylic acid material and initiator are added with agitation, although they could have been added prior to heating. When the reaction is complete, the excess acid material can be eliminated by an inert gas purge, e.g., nitrogen sparging.

The grafting is preferably carried out in a mineral lubricating oil which need not be removed after the grafting step but can be used as the solvent in the subsequent reaction of the graft polymer with the amine material and as a solvent for the end product to form the lubricating additive concentrate. The oil having attached, grafted carboxyl groups, when reacted with the amine material will also be converted to the corresponding derivatives but such derivatives are of little use to improvement in performance.

A description for functionalizing in a masticator can be found in U.S. Pat. No. 4,735,736, and a description for functionalizing the copolymers, dissolved in a solvent such as mineral oil, in a reactor can be found in U.S. Pat. No. 4,517,104, the disclosures of which are herein incorporated by reference.

In contrast, reactions carried out in the polymer melt, particularly in an extruder, are characterized by maximized reaction rates and minimized reactor volumes (due to the absence of a diluent solvent), by absence of side reactions with the solvent and by minimized residence times (due to the absence of dissolution and recovery steps before and after the reaction, respectively). Methods for extruder grafting are disclosed in commonly assigned U.S. Pat. No. 5,290,461, the disclosure of which is herein incorporated by reference.

In order to prevent or minimize the crosslinking or gellation of the grafted copolymer, particularly when it is subsequently aminated with amines having more than one reactive primary or secondary nitrogens, an optional acid functionalized low molecular weight hydrocarbyl component can be added to the functionalized polymers to moderate molecular weight growth of the derivatized polymer. Such materials are referred to herein as "Growth Regulators". Suitable Growth Regulators include. hydrocarbyl substituted succinic anhydride or acid having 12 to 49 carbons, preferably 16 to 49 carbons in said hydrocarbyl group, long chain monocarboxylic acid of the formula RCOOH where R is a hydrocarbyl group of 50 to 400 carbons and long chain hydrocarbyl substituted succinic anhydride or acid having 50 to 400 carbons in said hydrocarbyl group. Primarily because of its ready availability and low cost, the hydrocarbyl portion, e.g., alkenyl groups, of the carboxylic acid or anhydride is preferably derived from a polymer of a $C_2$ to $C_5$ monoolefin, said polymer generally having a molecular weight of about 140 to 6500, e.g., 700 to about 5000, most preferably 700 to 3000 molecular weight. Particularly preferred is polyisobutylene of 950 molecular weight.

Derivatized Polymers

A derivatized polymer is one which has been chemically modified to perform one or more functions in a significantly improved way relative to the unfunctionalized polymer and or the functionalized polymer. The primary new function sought to be imparted to the functionalized polymers of the present invention is dispersancy in lubricating oil compositions. Thus, the derivatized polymers used in the invention are the reaction products of the above recited functionalized polymers with amines.

Of the various amines useful in the practice of this invention, one amine type has two or more primary amine groups, wherein the primary amine groups may be unreacted, or wherein one of the amine groups may already be reacted. Particularly preferred amine compounds include alkylene polyamines, polyoxyalkylene polyamines, preferably wherein the alkylene groups are straight or branched chains containing from 2 to 7, and more preferably 2 to 4 carbon atoms.

Examples of the alkylene polyamines include methylene amines, ethylene amines, butylene amines, propylene amines, pentylene amines, hexylene amines, heptylene amines, octylene amines, other polymethylene amines, the cyclic and higher homologs of these amines such as the piperazines, the amino-alkyl-substituted piperazines, etc. These amines include, for example, ethylene diamine, diethylene triamine, triethylene tetramine, propylene diamine, di(heptamethylene)triamine, tripropylene tetramine, tetraethylene pentamine, trimethylene diamine, pentaethylene hexamine, di(trimethylene)triamine, 2-heptyl-3-(2-aminopropyl)imidazoline, 4-methylimidazoline, 1,3-bis-(2-aminoethyl)imidazoline, pyrimidine, 1-(2-aminopropyl)-piperazine, 1,4-bis-(2-aminoethyl)piperazine, N,N-dimethyaminopropyl amine, N,N-dioctylethyl amine, N-octyl-N'-methylethylene diamine, 2-methyl-1-(2-aminobutyl) piperazine, etc. The ethylene amines which are particularly useful are described, for example, in the Encyclopaedia of Chemical Technology under the heading of "Ethylene Amines" (Kirk and Othmer), Volume 5, pgs. 898–905. Interscience Publishers, New York (1950).

The polyoxyalkylene polyamines are preferably polyoxyalkylene diamines and polyoxyalkylene triamines, and may typically have average molecular weights ranging from 200 to 4000 and preferably from 400 to 2000. The preferred polyoxyalkylene polyamines include the polyoxyethylene and polyoxypropylene diamines and the polyoxypropylene triamines having average molecular weights ranging from 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

Primary amines are more preferred because of the stability of the imide products formed. Most preferred are primary amines, $RNH_2$, in which the R group contains functionalities that it is desired to have in the final product. Although such products contain two functionalities, the imide functionality formed by reaction of the primary amine is relatively inert and serves as a stable linkage between the functionality in the R group and the polymer backbone. In this invention it is desired that the R group of the primary amine $RNH_2$ contain tertiary amine functionality.

Examples of useful primary amines, $RNH_2$, in which the R group contains tertiary amine functionality include: N,N-dimethylethylenediamine, N,N-diethylethylenediamine, N,N-dimethyl-1,3-propanediamine, N,N-diethyl-1,3-propanediamine, 4-aminomorpholine, 4-(aminomethyl) pyridine, 4-(2-aminoethyl)morpholine and 4-(3-aminopropyl)morpholine. Preferred reactive compounds for reaction with grafted maleic anhydride in the practice of this invention are 4-(3-aminopropyl)morpholine and 1-(2-aminoethyl)- piperazine.

Still other amines useful in the practice of this invention include amino-aromatic polyamine compounds such as N-arylphenylenediamines. Particularly preferred N-arylphenylenediamines are the N-phenylphenylenediamines, for example, N-phenyl-1,4-phenyienediamine, N-phenyl-1,3-phenylenediamine, N-phenyl-1,2-phenylenediamine, N-naphthyl-phenylenediamine, N-phenyl-naphthalenediamine and N'-aminopropyl-N-phenylphenylene- diamine.

Other useful amines include aminothiazoles such as aminothiazole, aminobenzothiazole, aminobenzothiadiazole and aminoalkylthiazole, aminopyrroles, phenothiazines and phenothiazine derivatives, particularly 10-aminopropyl-phenothiazine, amino-3-propylaminophenothiazine, N-amino-propyl-2-naphthylamine and N-aminopropyidiphenylamine.

Mixtures of amines, particularly mixtures of two or more of the above compounds, may be used.

As indicated above, functionalization can be conducted separately on the high and low ethylene content polymers or the high and low ethylene content polymers can be blended at the aforedescribed blend ratios and then functionalized. If the latter option is employed, derivatization is conducted on the blend. If separate functionalization is employed, one has the additional options of derivatizing separately and blending the final derivatized products or blending the separately functionalized copolymers and derivatizing the blend simultaneously.

The functionalized ethylene alpha-olefin copolymers can be derivatized with amine in the melt or in solution. Melt derivatizations can in turn be conducted in an extruder or masticator, when conditions are substantially the same as the functionalization step. A stripping step can take place prior to amination to remove the unwanted by-products of the graft step which can lead to undesirable by-products as a consequence of the amination. When the amination takes place in a reactor, the functionalized polymer is dissolved in solution (e.g., in oil) at an amount of typically from 5 to 30, preferably 10 to 20, wt. percent polymer, based on the solution weight. Accordingly, the functionalized polymer is preheated at a temperature of from about 100° C. to 250° C., preferably from 170° to 230° C., said amine and optional growth regulator added and temperatures maintained for from 1 to 10 hours, usually 2 to 6 hours.

It has been found that many of these multifunctional viscosity modifiers which contain unreacted primary or secondary amine, can undergo an increase in molecular weight which is manifested by product gellation or viscosity growth of the resultant concentrates in oil. For this reason it has been found useful to post-treat or cap these products with an acid such as a $C_{12}$ to $C_{16}$ hydrocarbyl substituted dicarboxylic acid or anhydride to stabilize the molecular weight.

The lubricating oils of the invention typically contain a minor amount, e.g. 0.001 up to 50 mass percent, preferably 0.005 to 25 mass percent, based on the weight of the lubricating oil, of the derivatized copolymers as MFVM. The viscosity modifier system used in the invention will be used in an amount to give the required viscosity characteristics. When used in lubricating oils for automotive or diesel crankcase lubrication the MFVM is present at concentrations usually within the range of from 0.01 to 10 mass percent, e.g., 0.1 to 6.0 mass percent, preferably 0.25 to 3.0 mass percent (measured as polymer), of the total composition.

A single multifunctional viscosity modifier may be used alone, or it may be used in combination with additional conventional viscosity modifiers, either monofunctional or multifunctional.

Additional additives are typically incorporated into the compositions of the present invention. Examples of such additives are ashless dispersants, metal or ash containing detergents, antioxidants, anti-wear agents, friction modifiers, rust inhibitors, anti-foaming agents, demulsifiers, and pour point depressants.

D. Detergent

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralised detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

E. Antiwear and Antioxidant Agent

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula.

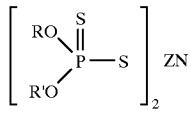

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. Conveniently at least 50 (mole) % of the alcohols used to introduce hydrocarbyl groups into the dithiophosphoric acids are secondary alcohols.

Oxidation inhibitors or antioxidants reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines. The aromatic rings are typically substituted by one or more substituents selected from alkyl, cycloalkyl, alkoxy, aryloxy, acyl, acylamino, hydroxy, and nitro groups.

OTHER ADDITIVES

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers include esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 11 4, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazoie polysuifides containing from 5 to 50 carbon atoms, their derivatives and polymers thereof. Derivatives of 1,3,4 thiadiazoies such as those described in U.S. Pat. Nos. 2,719,125; 2,719,126, and 3,087,932, are typical. Other similar materials are described in U.S. Pat. Nos. 3,821,236; 3,904,537; 4,097,387; 4,107,059; 4,136,043. 4,188,299. and 4,193,882. Other additives are the thio and polythio sulfenamides of thiadiazoies such as those described in UK. Patent Specification No. 1,560,830. Benzotriazoies derivatives also fall within this class of additives. When these compounds are included in the lubricating composition, they are preferably present in an amount not exceeding 0.2 mass % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Lubricating compositions may also contain elastomer comparability aids for elastomeric seals such as Viton or fluorocarbon seals and nitrile seals. Carboxylic acids and unsaturated hydrocarbons have been used for such a purpose.

Some of the above-mentioned additives can provide a multiplicity of effects; thus for example, a single additive may act as a dispersant-oxidation inhibitor. This approach is well known and does not require further elaboration.

When lubricating compositions contain one or more of the above-mentioned additives, each additive is typically blended into the base oil in an amount which enables the additive to provide its desired function. Representative effective amounts of such additives, when used in crankcase lubricants, are listed below. All the values listed are stated as mass percent active ingredient.

| Additive | Mass % (Broad) | Mass % (Preferred) |
|---|---|---|
| Ashless Dispersant | 0.1–3 | 1–3 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Anti-oxidant | 0–5 | 0.01–2 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–10 | 0.25–3 |
| Low Saturate Base Oil | Balance | Balance |

In a preferred embodiment of the invention the oil comprises not more than 2 mass % of ashless dispersant and preferably does not contain monofunctional viscosity modifier.

The components may be incorporated into a base oil in any convenient way. Thus, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate or additive package described herein as the detergent inhibitor package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

Preferably the detergent inhibitor package is made in accordance with the method described in U.S. Pat. No. 4,938,880. That patent describes making a premix of ashless dispersant and metal detergents that is pre-blended at a temperature of at least about 1000° C. Thereafter the premix is cooled to at least 85° C. and the additional components are added.

The final formulations may employ from 2 to 18 mass % and preferably 4 to 15 mass % of the concentrate or additive package (including any diluent or solvent contained in individual additives) with the remainder being viscosity modifier (in an appropriate amount to give the desired viscometrics) and base oil.

The invention will now be described by of illustration only with reference to the following examples.

EXAMPLE 1

An SAE 15W-40 oil of the invention prepared from a basestock of 64 mass % saturates was tested in the Sequence VE engine test, using a detergent inhibitor package with a reduced amount of ashless dispersant such that the level of active ingredient of the ashless dispersant is approximately 1.75 mass %. At a treat rate of 9.5 mass % of the preferred multifunctional viscosity modifier as described in WO-A-94/13763, without any monofunctional viscosity modifier a passing engine test result was obtained. Details of the oil and test result are set out in the Table below.

| Example | 1 |
|---|---|
| Basestock (mass %) | 56.5% BP 150ME<br>24.0% BP 500ME<br>Total saturates 64% |
| Viscosity Modifier (mass %) | 9.5% PARATONE 8500[1] |
| Additive Package (mass %) | 10.0% additive package[2] |
| Sequence VE Engine Test Results | |
| Sludge Rating (pass = 9.0 for API SH quality level) | 9.1 |
| Varnish Rating (pass = 5.0 for API SH quality level) | 6.0 |
| Cam Lobe Wear (pass = 5.0 for API SH quality level) | 3.1 |

Footnotes:
[1]multifunctional viscosity modifier according to WO-A-94/13763 commercially available from Exxon Chemical Company and comprising an oil solution of a blend of derivatised polymers, with a polymer content of 10.2 mass %;
[2]a detergent inhibitor package comprising ashless dispersant, metal-containing detergents, antioxidant, anti-wear additive, anti-foam additive, demulsifier, friction modifier and seal comparability aid.

We claim:

1. A multigrade lubricating oil for an internal combustion engine having low and high temperature viscosity requirements which comprises:

a. a basestock of lubricating oil viscosity having at least 20 mass % of aromatics and less than 75 mass % of saturated hydrocarbons;

b. less than 3 mass % of ashless dispersant derived from a polymer of number average molecular weight ($\overline{M}$) of not greater than 5000; and c. viscosity modifier to give the low and high temperature viscosity requirements, which comprises at least one multifunctional viscosity modifier.

2. An oil as claimed in claim 1, in which the overall saturates level of the basestock is less than 70 mass %.

3. An oil as claimed in claim 1, in which the overall saturates level of the basestock is less than 65 mass %.

4. An oil as claimed in claim 1, in which the multifunctional viscosity modifier comprises a derivatized ethylene-alpha olefin copolymer comprising an adduct of (i) a copolymer having a number average molecular weight of from 20,000 to 100,000, functionalized with mono- or dicarboxylic acid material; and (ii) at least one amine.

5. An oil as claimed in claim 4, in which the e thylene-alpha olefin copolymer comprises either a) from 30 to 60 mass % monomer units derived from ethylene and from 70 to 40 mass % monomer units derived from alpha-olefin, or b) from 60 to 80 mass % monomer units derived from ethylene and from 40 to 20 mass % monomer units derived from alpha olefin.

6. An oil as claimed in claim 1, in which the multifunctional viscosity modifier comprises a mixture of derivatised ethylene-alpha olefin copolymers A and B, both comprising an adduct of (i) a copolymer having a number average molecular weight of from 20,000 to 100,000, functionalized with mono- or dicarboxylic acid material; and (ii) at least one amine, and wherein:

the ethylene-alpha olefin copolymer of derivatized copolymer A comprises from 30 to 60 mass % monomer units derived from ethylene and from 70 to 40 mass % monomer units derived from alpha-olefin; and the ethylene-alpha olefin copolymer of derivatized copolymer B comprises from 60 to 80 mass % monomer units derived from ethylene and from 40 to 20 weight percent monomer units derived from alpha-olefin, with the proviso that the respective weight percents of ethylene derived monomer units present in said derivatized copolymers A and B differ by at least 5 mass %.

7. An oil as claimed in claim 1, which is substantially free of monofunctional viscosity modifier and comprises an ashless dispersant in an amount not greater than 2 mass % (on the basis of active ingredient).

8. A method for reducing or inhibiting varnish deposits in an internal combustion engine comprising lubricating the internal combustion engine with a multigrade lubricating oil which comprises a basestock of lubricating oil viscosity having at least 20 mass % of aromatics and less than 75 mass % of saturated hydrocarbons, less than 3 mass % of ashless dispersant derived from a polymer of number average molecular weight ($\overline{M}$n) of not greater than 5000, and a viscosity modifier to meet low and high temperature viscosity requirements for said multigrade lubricating oil which comprises at least one multifunctional viscosity modifier.

9. A method according to claim 8 wherein the overall saturates level of the basestock is less than 70 mass %.

10. A method according to claim 8 wherein the overall saturates level of the basestock is less than 65 mass %.

11. A method according to claim 8 wherein the multifunctional viscosity modifier comprises a derivatized ethylene-alpha olefin copolymer comprising an adduct of (i) a copolymer having a number average molecular weight of from 20,000 to 100,000, functionalized with mono- or dicarboxylic acid material; and (ii) at least one amine.

12. A method according to claim 11 wherein the ethylene-alpha olefin copolymer comprises either a) from 30 to 60 mass % monomer units derived from ethylene and from 70 to 40 mass % monomer units derived from alpha-olefin, or b) from 60 to 80 mass % monomer units derived from ethylene and from 40 to 20 mass % monomer units derived from alpha olefin.

13. A method according to claim 8 wherein the multifunctional viscosity modifier comprises a mixture of derivatised ethylene-alpha olefin copolymers A and B, both comprising an adduct of (i) a copolymer having a number average molecular weight of from 20,000 to 100,000, functionalized with mono- or dicarboxylic acid material; and (ii) at least one amine, and wherein:

the ethylene-alpha olefin copolymer of derivatized copolymer A comprises from 30 to 60 mass % monomer units derived from ethylene and from 70 to 40 mass % monomer units derived from alpha-olefin; and the ethylene-alpha olefin copolymer of derivatized copolymer B comprises from 60 to 80 mass % monomer units derived from ethylene and from 40 to 20 weight percent monomer units derived from alpha-olefin, with the proviso that the respective weight percents of ethylene derived monomer units present in said derivatized copolymers A and B differ by at least 5 mass %.

14. A method according to claim 8 in which the multigrade lubricating oil is substantially free of monofunctional viscosity modifier and comprises an ashless dispersant in an amount not greater than 2 mass % (on the basis of active ingredient).

* * * * *